US006680705B2

(12) United States Patent
Tan et al.

(10) Patent No.: US 6,680,705 B2
(45) Date of Patent: Jan. 20, 2004

(54) CAPACITIVE FEED INTEGRATED MULTI-BAND ANTENNA

(75) Inventors: Huan Fong Tan, Singapore (SG); Gim Sian Tan, Singapore (SG); Foo Luen Wong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/177,452

(22) Filed: Jun. 20, 2002

(65) Prior Publication Data

US 2003/0189525 A1 Oct. 9, 2003

(30) Foreign Application Priority Data

Apr. 5, 2002 (SG) ..... 200202045

(51) Int. Cl.[7] ..... H01Q 1/24; H01Q 13/10

(52) U.S. Cl. ..... 343/702; 343/700 MS; 343/767; 343/770

(58) Field of Search ..... 343/702, 700 MS, 343/767, 770, 846

(56) References Cited

U.S. PATENT DOCUMENTS

| | | | | |
|---|---|---|---|---|
| 5,764,190 | A | 6/1998 | Murch et al. | 343/702 |
| 2003/0098812 | A1 * | 5/2003 | Ying et al. | 343/702 |

FOREIGN PATENT DOCUMENTS

| | | | |
|---|---|---|---|
| EP | 0871238 | 10/1998 | H01Q/9/04 |
| EP | 1018779 | 7/2000 | H01Q/9/04 |
| EP | 1108616 | 6/2001 | H01Q/21/06 |
| WO | WO01/82412 | 11/2001 | H01Q/9/04 |
| WO | WO03/047031 | 6/2003 | H01Q/19/00 |

OTHER PUBLICATIONS

Rowell C R et al: "A Compact Pifa Suitable For Dual–Frequency 900/1800–Mhz Operation" IEEE Transactions on Antennas and Propagation, IEEE Inc. New York, US, vol. 46, No. 4, Apr. 1, 1998, pp. 596–598, XP000750738, ISSN: 0018–926X.

Sanad M et al: "Compact Internal Multiband Microstrip Antennas For Portable GPS, PCS, Cellular And Satellite Phones" Microwave Journal, Horizon House, Dedham, US, vol. 42, No. 8, Aug, 1999, pp. 90, 92, 94–96, 98, XP000930153, ISSN: 0192–6225.

* cited by examiner

*Primary Examiner*—Hoang V. Nguyen

(57) ABSTRACT

An apparatus for a capacitive feed planar inverted-F (PIFA) multi-band antenna is provided. The antenna structure of the present invention typically comprises of a ground element, a main radiating element, having predefined slits and arranged above the ground element, and a capacitive feed element. The capacitive feed element is electrically connected to an antenna feed and is detached from the main radiating and ground elements. By having additional secondary elements, the bandwidth or the number of resonant frequencies of the antenna can be increased without increasing the overall dimensions of the antenna.

11 Claims, 7 Drawing Sheets

CAPACITIVE FEED INTEGRATED MULTI-BAND ANTENNA

BACKGROUND OF THE INVENTION

1. Field of the Invention

The present invention relates to an improved planar inverted-F antenna (PIFA), and in particular to a capacitive feed planar inverted-F multi-band antenna.

2. Description of Background Information

Antenna is an essential part of a wireless device. Over the years, wireless devices have been rapidly miniaturizing, thus increasing demand for integrated or built-in antennas. Concurrently, there has been an influx of wireless services and users. To cope with increasing usage and demand, many wireless devices and networks have since migrated from single band operation to dual band (or multi-band) operation to improve network capacity and coverage, and to provide users with seamless quality service.

A common integrated antenna used in wireless devices is the Planar Inverted-F Antenna (PIFA). The PIFA is a widely favored integrated antenna because it provides for a more compact antenna with an approximate length of $\lambda/4$, which is an improvement over a length of $\lambda/2$. A typical PIFA is shown in FIG. 1. The PIFA structure shown has a planar radiating element characterized by slits for defining two lips or length portions. Each lip corresponds to a resonant frequency at which the antenna operates. The radiating element has a feed point for directly connecting the radiating element to an antenna feed, and a short circuit point for connecting the radiating element to a ground element arranged below the radiating element. The described antenna structure of FIG. 1 is commonly known as a direct feed PIFA.

The direct feed PIFA is easy to design and fabricate, but its main disadvantage is insufficient bandwidth to support multi-band operation. Accordingly, there is a need to improve antenna performance by increasing bandwidth of a multi-band antenna while providing for a smaller form factor.

SUMMARY OF THE INVENTION

The present invention provides an integrated capacitive feed planar inverted-F antenna (PIFA) for multi-band operation. A typical embodiment of the present invention comprises a ground element, and a main radiating element arranged at a predetermined height from the ground element, the main radiating element having slits for defining lips. At one end of the main radiating element, it is short-circuited to the ground element. A feed element is arranged in the vertical gap between the ground and the main radiating elements. The feed element is detached (or separated by a gap) from the ground and main radiating elements to create capacitive feeding. For efficient feeding, the feed element may be arranged substantially parallel to the main radiating element. The invention also comprises an antenna feed which is electrically connected to the feed element, but detached from the main radiating and ground elements.

Secondary (or sub-radiating) elements may also be arranged in the vertical gap and proximate to the feed element for creating an additional resonant frequency or for improving bandwidth performance. The secondary elements are detached (or separated by a gap) from the main radiating, feed and ground elements.

BRIEF DESCRIPTION OF THE DRAWINGS

Embodiments of the present invention will be described with reference to the accompanying drawings, in which.

DETAILED DESCRIPTION

Figure 1:
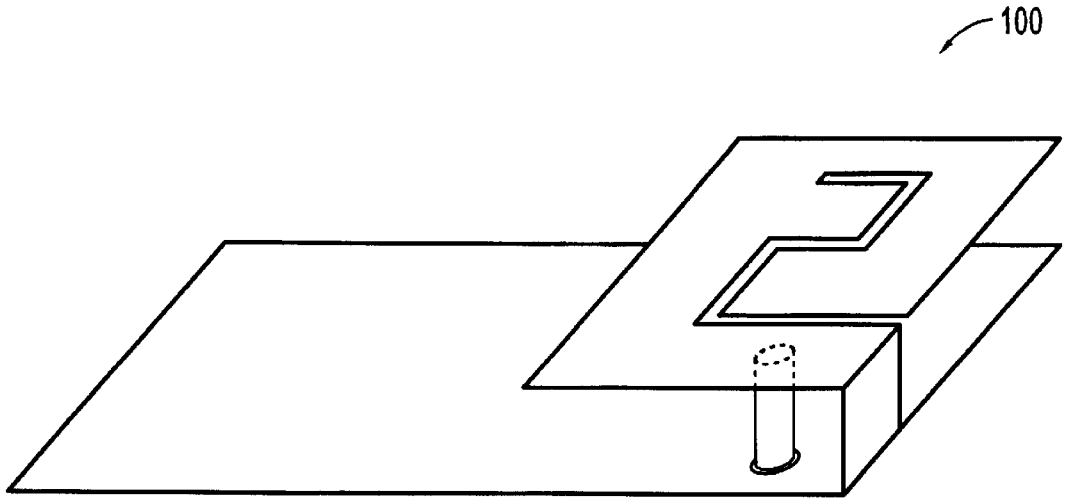
FIG. 1 shows a prior art direct feed PIFA.
Figure 2:
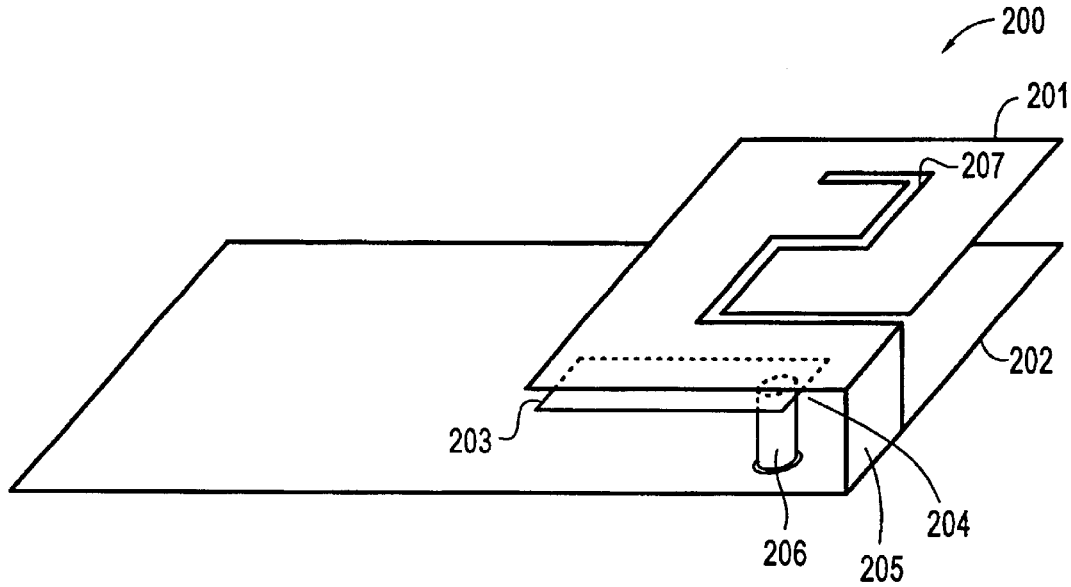
FIG. 2 shows an antenna structure according to a first embodiment of the present invention.

FIG. 2 shows an antenna structure according to a first embodiment 200 of the present invention. According to the first embodiment 200, the antenna structure comprises a ground element 202, and a main radiating element 201 arranged at a predetermined distance from the ground element 202. The ground element may be in the form of a planar structure, or may form part of a casing embodying the present invention, or the like. The main radiating element 201 is characterized by slits 207 cut from an edge of the main radiating element 201 to divide the main radiating element 201 into two lips. From the perspective of a feed point 204 (see FIG. 2), the lips have unequal lengths for providing two resonant frequencies for dual band operation. The resonating frequencies of the antenna are dependent on namely the dimensions of the lips, and the dimensions and the number of slits 207. The resonant frequencies may also be dependent on the vertical gap distance between main radiating element 201 and the ground element 202. To tune the antenna to operate at a different frequency, the dimensions of any of the lips and slits 207 are varied.

At one end of the main radiating element 201, the main radiating element 201 has a short-circuit point 205 for connecting the main radiating element 201 to the ground element 202. The short-circuit point 205 is typically formed by connecting both elements with an electrically conductive strip or wire.

The antenna structure 200 also comprises a feed element 203 arranged at a first predetermined height in a vertical gap between the main radiating element 201 and the ground element 202, and separated from both the main radiating 201 and ground 202 elements (i.e. detached) to create capacitive feeding.

The feed element 203 is arranged directly below the main radiating element 201 along a lip portion common to both lips (or referred to as a common lip portion). The feed element 203 is illustrated as a rectangular metal strip. If required, the feed element 203 may form an L shape or any shape conforming with a lip portion common to both lips. To achieve a desired bandwidth performance, the feed element 203 may be tuned by varying its dimensions or by varying the gap between the main radiating element 201 and the feed element 203.

The feed element 203 has a feed point 204 for electrically connecting to an antenna feed 206 for feeding an input signal. The feed point 204 is positioned at an end closest to the short circuit point 204. The distance from the short circuit point to the feed point determines the impedance of the antenna system. The feed 206 is also detached from other elements, i.e., ground 202 and main radiating 201 elements, as known to a person skilled in the art.

As an illustration, the main radiating element 201 used in the present invention is a conductive plate measuring 30 mm by 20 mm to provide for a small form factor. However, it may take other shapes without departing from the invention.

The vertical gap separating the feed element 203 from the main radiating element 201 is predetermined and will be discussed in greater detail in later paragraphs. The vertical gaps separating the ground element 202 and the feed element 203, the feed element 203 and the main radiating element 201, are typically filled with air. If a dielectric is arranged in place of air, parameters on the vertical gap and dimensions of the sub-radiating elements may differ. A smaller antenna form factor may be achieved but may result in a lossy antenna system.

The present invention is advantageous as it realizes a wider bandwidth at the resonant frequencies while achieving a smaller form factor. A comparison of the bandwidth performance of a direct feed antenna 100 (prior art) and a capacitive feed multi-band antenna in accordance with the present invention is illustrated by FIGS. 3 and 4.

Figure 3:
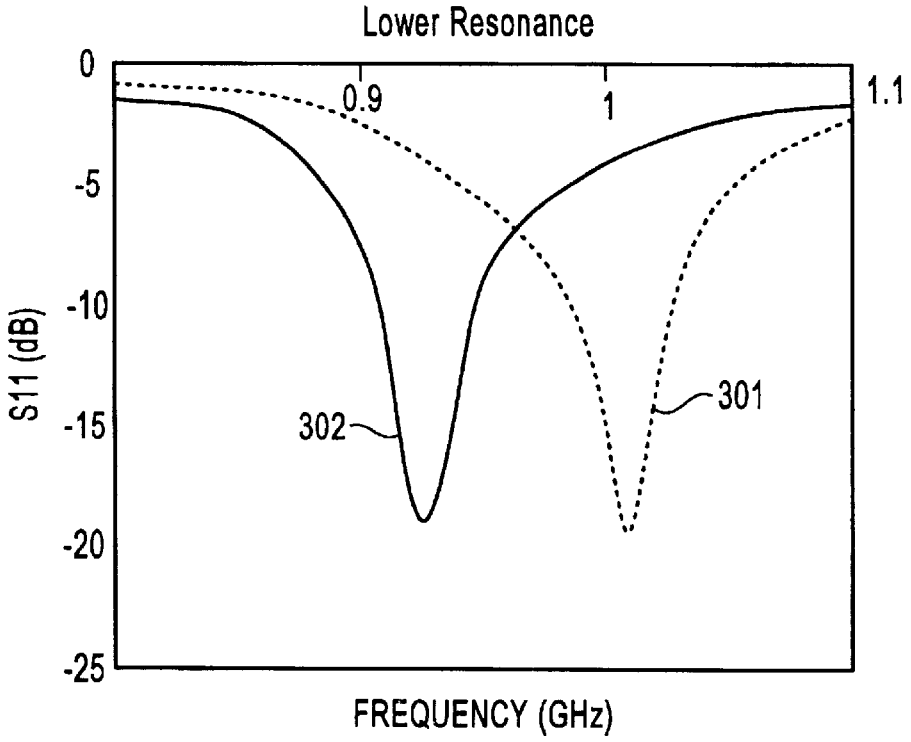
FIG. 3 shows the return loss (lower resonance) of a capacitive feed multi-band antenna in accordance with the first embodiment of the present invention, and a prior art direct feed PIFA.
Figure 4:
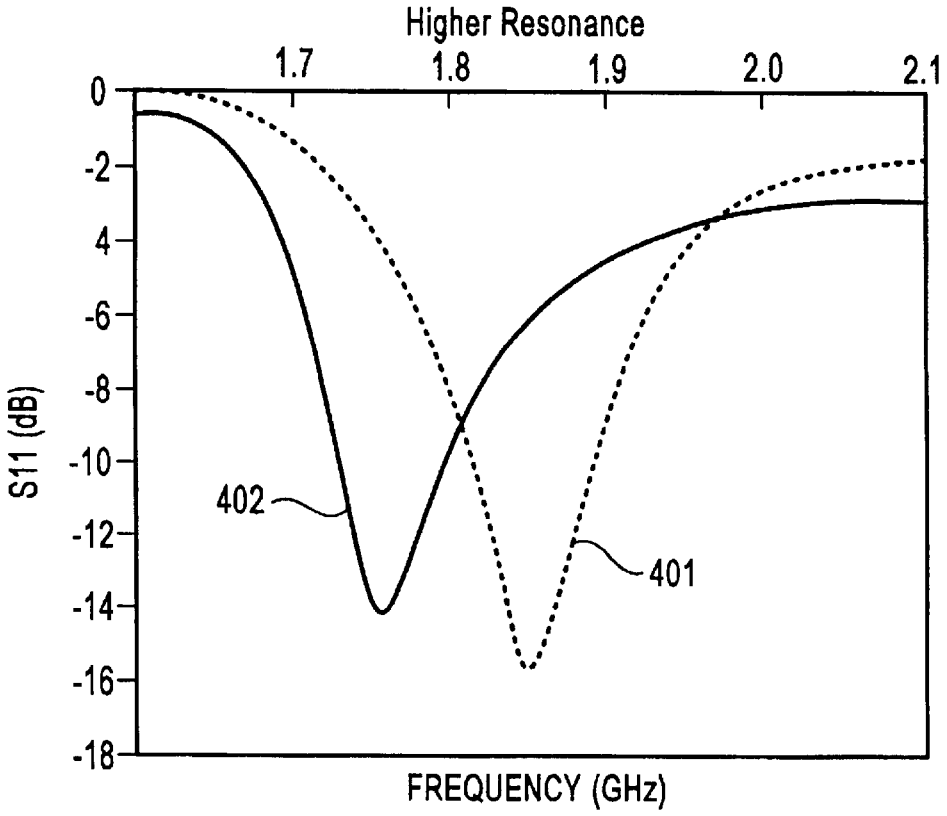
FIG. 4 shows the return loss (higher resonance) of a capacitive feed multi-band antenna in accordance with the first embodiment of the present invention, and a prior art direct feed PIFA.

FIGS. 3 and 4 show a graphical representation of the return loss of a capacitive feed PIFA according to the present invention and a direct feed PIFA 100 according to the prior art. The return loss of the prior art direct feed PIFA is indicated by curves 301 and 401. The return loss of a capacitive feed multi-band antenna according to the present invention is indicated by curves 302 and 402. The return loss of an antenna allows a person skilled in the art to determine resonant frequencies and bandwidth of the antenna. At 7 dB level of FIG. 3 illustrating return loss at a lower resonant frequency, the bandwidth factors of the direct feed antenna 100 and the capacitive feed multi-band antenna are calculated as 7.3% and 8.6% respectively. (Bandwidth factor= Bandwidth/resonant frequency) At 7 dB level of FIG. 4 illustrating return loss at a higher frequency, the bandwidth factors of the direct feed antenna 100 and the capacitive feed antenna are calculated as 4.8% and 5.6% respectively. Clearly, the present invention improves the bandwidth performance at both resonant frequencies.

Figure 5:
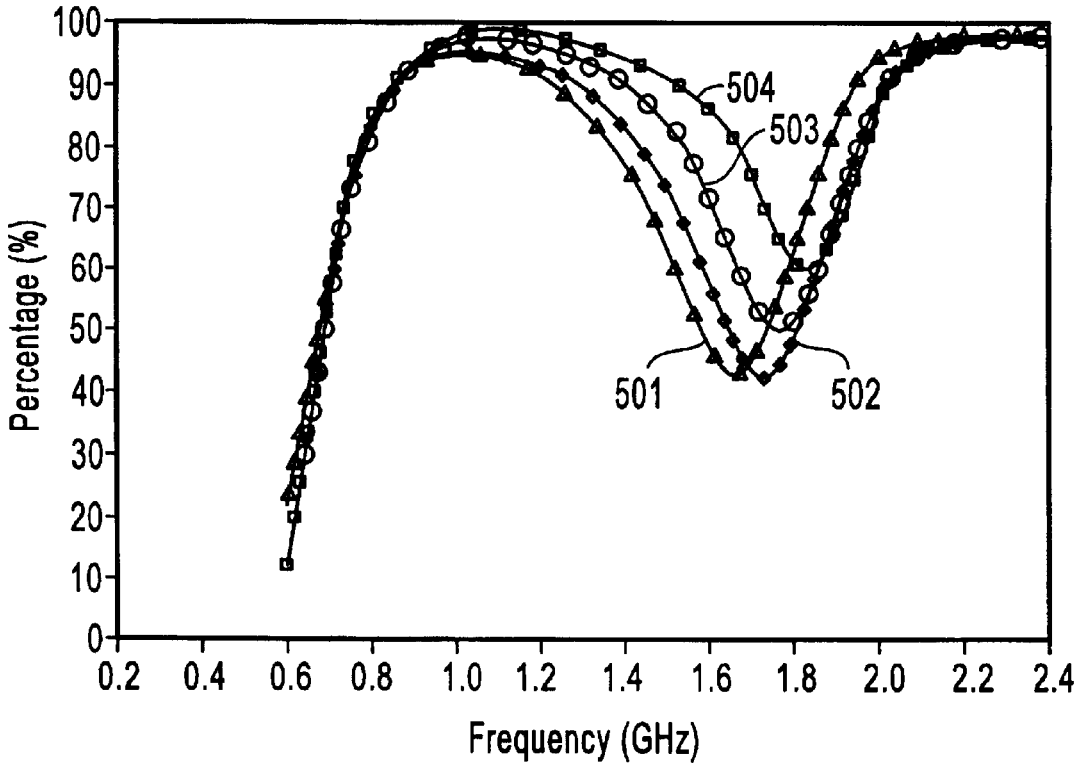
FIG. 5 shows the radiating efficiencies of a capacitive feed multi-band antenna and a prior art direct feed PIFA antenna.

Another advantage of the present invention employing a capacitive feed is a higher radiating efficiency. FIG. 5 is a graphical representation of radiating efficiency with respect to frequency and is obtained from a simulation performed using IE3® from Zeland Software, Inc.

FIG. 5 shows a comparison of radiating efficiency curves between a direct feed antenna 100 and a capacitive feed multi-band antenna having separately 2-mm (millimeter), 3-mm and 5-mm gaps. The gap refers to the vertical gap distance between the main radiating element 201 and the feed element 203. Their radiating efficiencies are indicated by curves 501, 502, 503 and 504 respectively. FIG. 5 shows that a direct feed antenna 100 has a lower radiating efficiency while a capacitive feed multi-band antenna, according to the present invention, has a higher radiating efficiency. Among the efficiency curves of a capacitive feed antenna, FIG. 5 shows that a 5-mm vertical gap provides an optimized radiating efficiency curve.

The return loss and radiating efficiency curves shown in FIGS. 3, 4 and 5 are based on a capacitive feed multi-band antenna 200 according to a first embodiment of the present invention and a direct feed antenna 100. Both antenna structures have identical dimensions and conditions for the main radiating element 201, ground element 202 and the antenna feed 206. FIGS. 3, 4 and 5 show that the bandwidth performance and radiating efficiency of a capacitive feed multi-band antenna is higher than a prior art direct feed antenna 100. Thus, it follows that to achieve similar performance as a prior art direct feed PIFA 100, the dimensions of a capacitive feed multi-band antenna are smaller than those of a direct feed PIFA 100. Accordingly, the dimensions of a capacitive feed multi-band antenna may be optimized for achieving both improved bandwidth performance and smaller form factor.

The foregoing description and advantages of a capacitive feed antenna for a dual band antenna are also applicable to embodiments employing secondary (or sub-radiating) elements, which will be described in the following paragraphs. The presence of secondary elements increases the bandwidth of the antenna and/or creates additional resonance for triple or quad-band operation. Examples of triple-band operation include Global Standard for Mobile Communication (GSM), Digital Communication System (DCS) and Personal Communication Service (PCS)).

Figure 6:
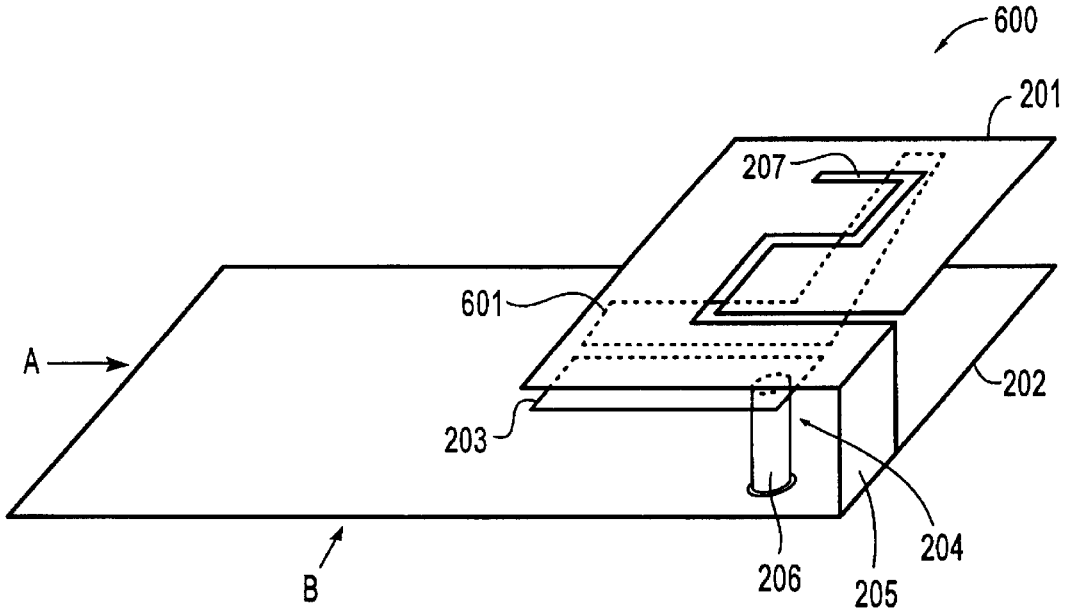
FIG. 6 shows an antenna structure according to a second embodiment of the present invention.

FIG. 6 shows an antenna structure according to a second embodiment 600 of the present invention. The structure and arrangement of the second embodiment 600 is similar to the first embodiment 200. Additionally, the second embodiment 600 has a first secondary element 601. The first secondary element 601 is arranged at a second predetermined height in the vertical gap separating the main radiating element 201 and the ground element 202. The second predetermined height may be the same as the first predetermined height of the feed element 203 to form a substantially same planar surface. However, the secondary element can be arranged at a different height.

As an illustration, the first secondary element 601 is shown as an L-shaped element. One arm of the L-shaped element is arranged proximate to the feed element 203 and separated by a gap. The L-shaped element may be formed by cutting away from a corner of a rectangular plate during the tuning process. In FIG. 6, the first secondary element 601 is shown as a flat structure, but it can be folded or contoured to conform to a shape required of a device embodying the invention. The shape and arrangement of the secondary element 601 should allow coupling with the main radiating element 201 and/or the feed element 203.

The first secondary element 601 is detached from other elements, such as, the feed element 203, main radiating element 201, ground element 202 and feed 206. Preferably, the gap separating the feed element 203 and the first secondary element 601 allows sufficient coupling between the two elements.

Figure 6A:
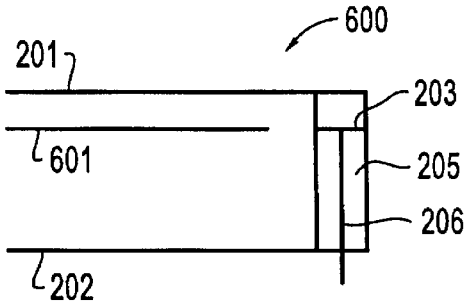
FIG. 6A is a cross-sectional view of the second embodiment taken from direction A.
Figure 6B:
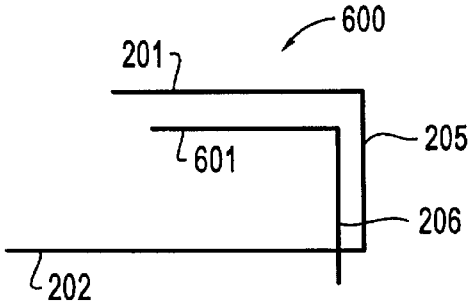
FIG. 6B is a cross-sectional view of the second embodiment taken from direction B.

FIGS. 6A and 6B illustrate a cross-sectional view taken from directions A and B respectively. It is understood by a person skilled in the art that the feed 206 is detached from the ground element 202.

Figure 7:
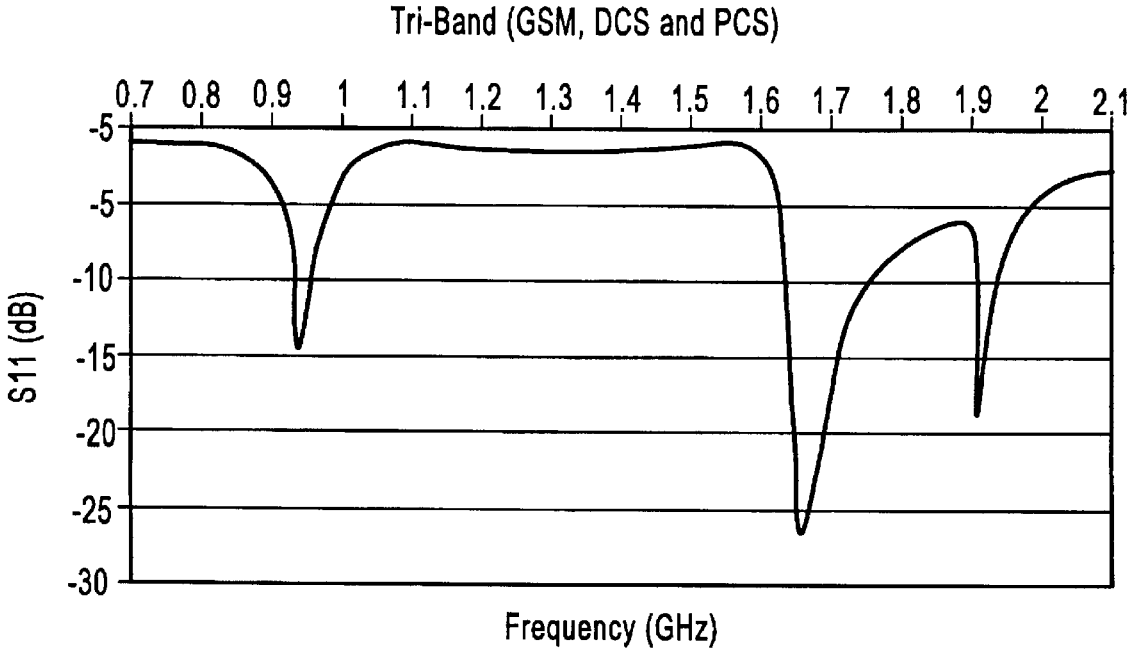
FIG. 7 shows the return loss of a capacitive feed multi-band antenna employing at least a secondary element for creating an additional resonance.

FIG. 7 shows the return loss of an antenna having at least a secondary element to create an additional resonance.

Figure 8:
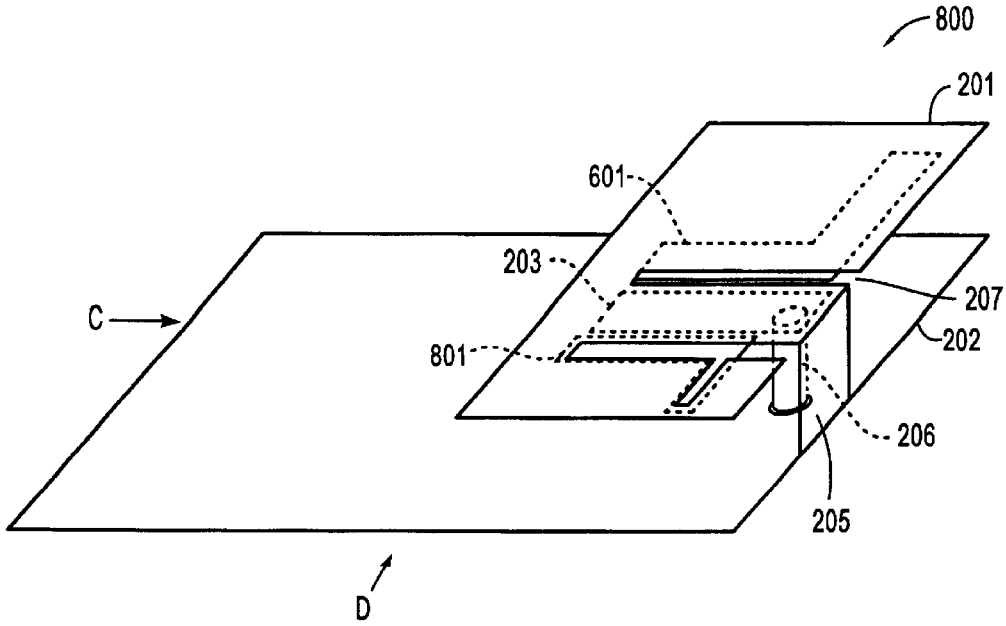
FIG. 8 shows an antenna structure according to a third embodiment of the present invention.

FIG. 8 shows an antenna structure according to a third embodiment 800 of the present invention. For purposes of illustration, the main radiating element 201 have slits 207 to provide two lips. In addition to the structure described for the second embodiment, the third embodiment has a second secondary element 801.

In the antenna structure of FIG. 8, the slits 207 and short circuit point 205 are defined differently from the previous embodiments to allow different arrangements of the secondary elements. Similar to the first 200 and second 600 embodiments, a feed element 203 is arranged at a first predetermined height in the vertical gap between the main radiating element 201 and the ground element 202, and below a lip portion common to both lips. The feed element 203 has a feed point 204 for connecting to the antenna feed 206. Similarly, the feed element 203 is detached from but proximate to the main radiating element 201 to create capacitive feeding. The feed element 203 is also detached from the ground 202 and other secondary elements (203, 601 and 801). The antenna feed 206 is electrically connected to the feed element 203 and detached from the ground 202 and other secondary elements (601 and 801).

Similar to the second embodiment, a first secondary element 601 is arranged in the vertical gap between the main radiating element 201 and ground element 202 at a second predetermined height. The first secondary element 601 is detached from and proximate to the feed element 203 as described for the second embodiment. The first secondary element 601 is also detached from the main radiating 201, ground 202 and other secondary elements (203 and 801).

As described earlier, the feed element 203 and the first secondary element 601 can be arranged at a same predetermined height to form a substantially same plane with the feed element 203. Alternatively, both secondary elements can be arranged at different predetermined heights, but should create coupling with the feed element 203 and/or the main radiating element 201.

A second secondary element 801 is arranged at a third predetermined height in the vertical gap between the main radiating element 201 and the ground element 202. The second secondary element 801 may be arranged to form a substantially same plane with the feed element 203 and/or the first secondary element 601 at the same height in the vertical gap. Alternatively, the second secondary element 801 may be arranged at a different height, but should create coupling with other secondary elements and/or with the main radiating element 201.

In FIG. 8, the second secondary element 801 is illustrated as an L-shaped member. One arm of the L-shaped element is arranged proximate to the feed element 203 and separated by a gap. The L-shaped element may be formed by cutting away from a corner of a rectangular plate during the tuning process. Similar to the first secondary element 601, the second secondary element 801 is detached from other elements (201, 203, 206, 601).

Figure 8A:
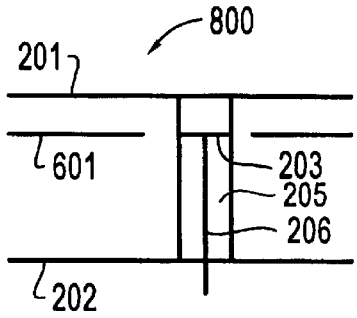
FIG. 8A is a cross-sectional view of the third embodiment taken from direction C.
Figure 8B:
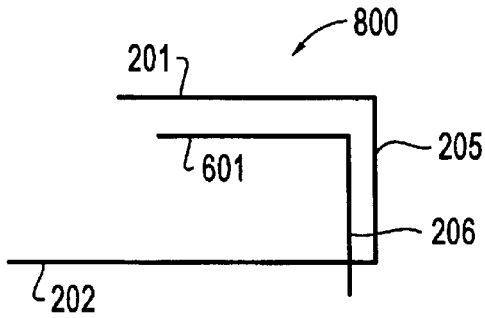
FIG. 8B is a cross-sectional view of the third embodiment taken from direction D

FIGS. 8A and 8B illustrate a cross-sectional view taken from directions C and D respectively. It is understood by a person skilled in the art that the feed 206 is detached from the ground element 202.

Figure 9:
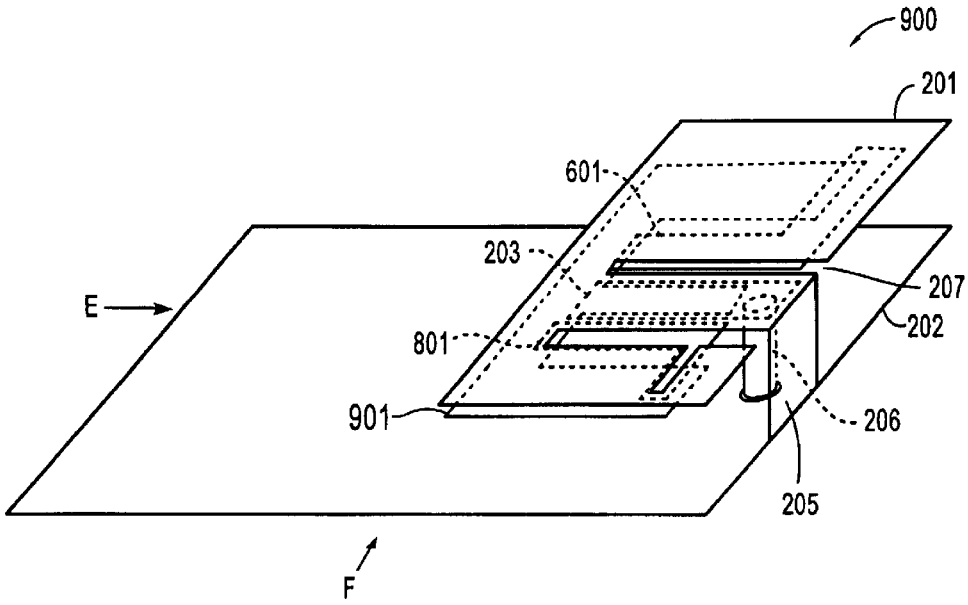
FIG. 9 shows an antenna structure according to a fourth embodiment of the present invention.
Figure 9A:
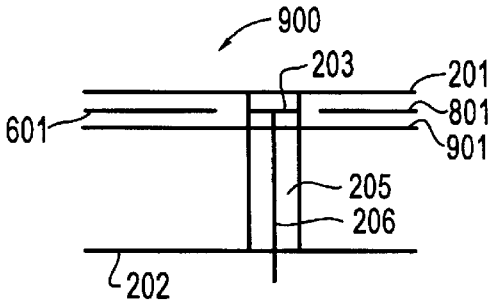
FIG. 9A is a cross-sectional view of the third embodiment taken from direction E.
Figure 9B:
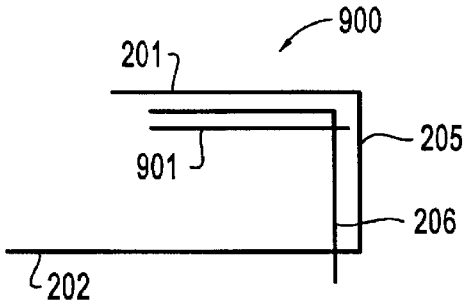
FIG. 9B is a cross-sectional view of the third embodiment taken from direction F.

FIG. 9 shows an antenna structure according to a fourth embodiment 900 of the present invention. The structure and arrangement of the fourth embodiment is similar to that of the third embodiment 800. Additionally, the fourth embodiment 900 has a third secondary element 901. The third secondary element 901 is arranged at a predetermined height in a vertical gap between the feed element 203 and the ground element 202. The third element 901 is arranged with at least a portion common with or overlapping with the feed element 203 to create coupling.

The fourth element 901 is illustrated in FIG. 9 as an E-shaped element, where the middle arm of the E-shaped element is common with the feed element 203 (i.e., the feed element 203 overlays the middle arm of the E-shape element). Alternatively, the fourth secondary element 901 may take other shapes. Similar to the first 601 and second 801 secondary elements, the third secondary element 901 is detached from and proximate to the other secondary elements, and is also detached from the main radiating 201, ground 202 element and feed 206.

For efficient coupling, the secondary elements (203, 601, 801 and 901) may be arranged substantially parallel to the main radiating element 201.

Preferably, each described secondary element (203, 601, 801, 901) has a surface area smaller than the main radiating element 201, and made of electrically conductive materials.

The described main radiating 201, ground 202, and secondary elements (203, 601, 801, 901) are illustrated herein as having flat structures. However, they may be folded or contoured to conform to an external casing of an internal structure of a device embodying the invention.

Typically, the antenna in accordance with the present invention may be incorporated in electronic devices with wireless communication capabilities, such as, phones, headphones, Wireless Digital Assistants (WDAs), organizers, portable computers, keyboards, joysticks, printers, and the like.

What is claimed is:

1. An antenna device, comprising:

a ground element;

a main radiating element arranged at a predetermined distance from the ground element, the main radiating element having slits for defining lips and having an end short-circuited to the ground element;

a feed element arranged at a predetermined height in a gap between the main radiating element and ground element, arranged along a common lip portion;

a feed electrically connected to the feed element; and a first secondary element arranged in the gap, and detached from and proximate to the feed element, wherein the feed and the feed element are detached from the main radiating and the ground elements.

2. The antenna device according to claim 1 wherein the first secondary element is arranged to form a substantially same plane with the feed element.

3. The antenna device according to claim 1 further comprising a second secondary element arranged in the gap, and detached from and proximate to the feed element.

4. The antenna device according to claim 3 wherein the second secondary element is arranged to form a substantially same plane with the feed element and the first secondary element.

5. The antenna device according to claim 3 further comprising a third secondary element arranged in the gap, and detached from and proximate to the feed element, wherein at least a portion of the third secondary element is common with the feed element.

6. The antenna device according to claim 5 wherein the third secondary element is arranged between the feed element and the ground element.

7. The antenna device according to claim 6 wherein the feed element, the first and the second secondary elements are arranged to form a substantially same plane.

8. An antenna device, comprising:

a ground element;

a main radiating element arranged at a predetermined distance from the ground element, the main radiating element having slits for defining lips and having an end short-circuited to the ground element;

a feed element arranged at a predetermined height in a gap between the main radiating element and ground element, and arranged along a common lip portion;

a feed electrically connected to the feed element; and a plurality of secondary elements arranged in the gap and proximate to the feed element, wherein the feed and the feed element are detached from the main radiating and the ground elements, and wherein the plurality of secondary elements are each detached from the main radiating element, the feed element and the ground element.

9. A method of increasing bandwidth and/or number of operation bands in an antenna, comprising the steps of:

defining at least two resonant frequencies with lips formed from slits on a main radiating element, wherein an end of the main radiating element is short-circuited to a ground element;

capacitively feeding the main radiating element with a feed element arranged along a common lip portion at a predetermined height in a gap between the main radiating element and the ground element;

feeding an input signal to the feed element at a location proximate to the short-circuit end; and coupling with the feed element using a first secondary element arranged in the gap, and detached from and proximate to the feed element.

10. The method according to claim 9 further comprises coupling with the feed element using a second secondary element arranged in the gap, and detached from and proximate to the feed.

11. The method according to claim 10 further comprises coupling with the feed element with a third secondary element having at least a portion common with the feed element, wherein the third secondary element is arranged proximate to and detached from the feed element in a gap between the feed element and the ground element.

* * * * *